US011071692B1

(12) United States Patent
Le

(10) Patent No.: US 11,071,692 B1
(45) Date of Patent: Jul. 27, 2021

(54) SUITABLE CONTAINER FOR CHILDREN AND ADULTS AT LYING AND SITTING POSITIONS

(71) Applicant: Khoa Tho Le, Northlenn, CO (US)

(72) Inventor: Khoa Tho Le, Northlenn, CO (US)

( * ) Notice: Subject to any disclaimer, the term of this patent is extended or adjusted under 35 U.S.C. 154(b) by 0 days.

(21) Appl. No.: 16/999,418

(22) Filed: Aug. 21, 2020

Related U.S. Application Data

(63) Continuation-in-part of application No. 16/709,419, filed on Dec. 10, 2019.

(60) Provisional application No. 62/797,402, filed on Dec. 5, 2019.

(51) Int. Cl.
*A61J 9/08* (2006.01)
*A61J 9/04* (2006.01)

(52) U.S. Cl.
CPC .. *A61J 9/08* (2013.01); *A61J 9/04* (2013.01)

(58) Field of Classification Search
CPC ... A47G 19/2272; A61J 11/002; A61J 11/006; A61J 11/06; A61J 9/006; A61J 9/06; B65D 49/04; B65D 39/06
See application file for complete search history.

(56) References Cited

U.S. PATENT DOCUMENTS 2,742,168 A * 4/1956 Panetti ..... A61J 11/002 215/11.4
2,877,917 A * 3/1959 Brooks ..... A61J 9/006 215/11.1
3,547,296 A * 12/1970 Greenberg ..... A61J 9/006 215/11.4
2006/0278597 A1* 12/2006 Daugherty ..... A61J 11/0085 215/11.1

* cited by examiner

*Primary Examiner* — Andrew T Kirsch

(57) ABSTRACT

A container comprises a nipple, a cap, a ball, a slide connecting a short tube and a long tube. The ball travels inside the slide. The short tube has a short tube bottom and is used for the lying position. The long tube has a long tube bottom and is used for the sitting position. The slide has a slide bottom. The slide bottom and the short tube bottom are interchangeable. When the ball seals the upper portion of the long tube, opening the short tube for fluid flow at the lying position. When the ball seals the short tube bottom, the short tube is closed opening the long tube for the fluid flow through the long tube at the sitting position. The nipple draws in the fluid from either the short or long tube depending upon the position a user is taking.

19 Claims, 9 Drawing Sheets

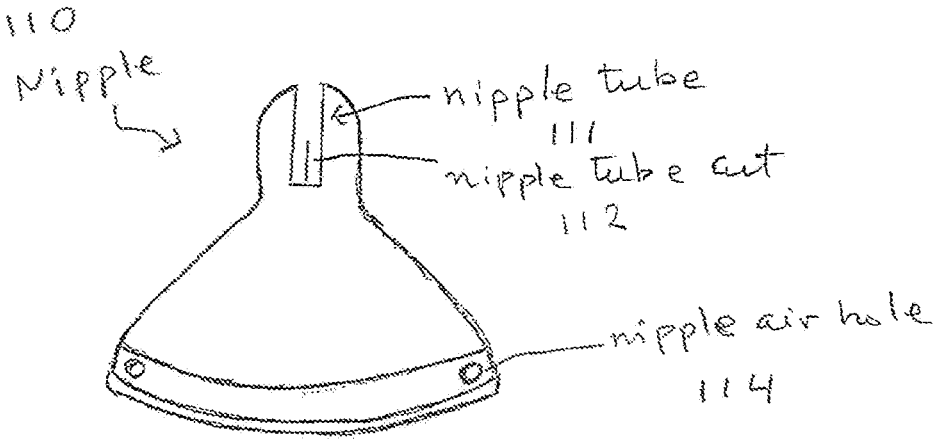
Figure 1 The Nipple
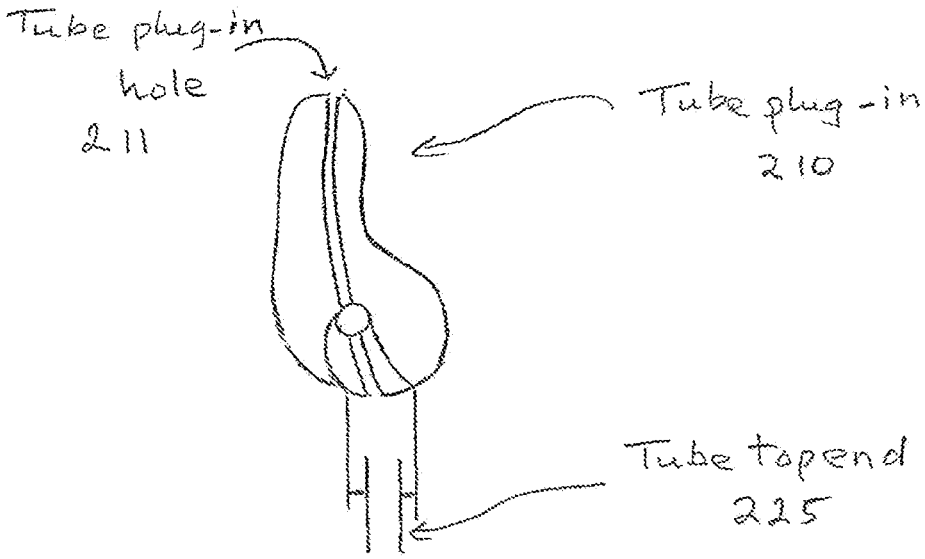
Figure 2 The tube plug-in

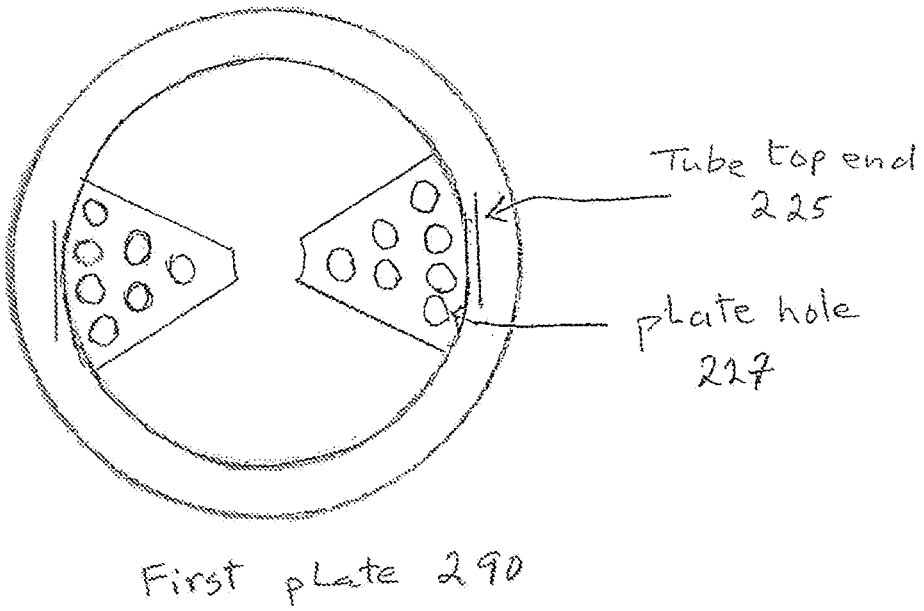
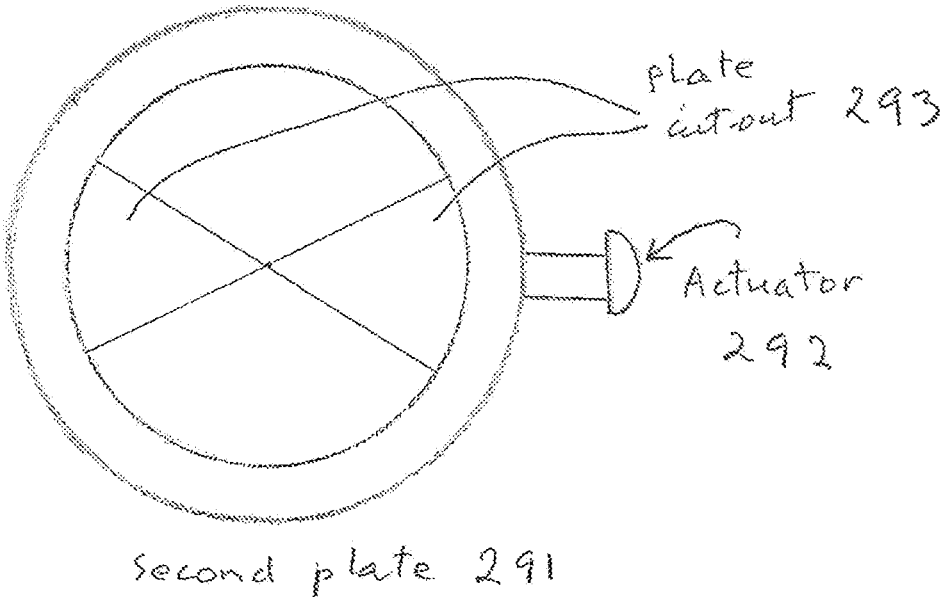
Figure 3 Flow Control mechanism

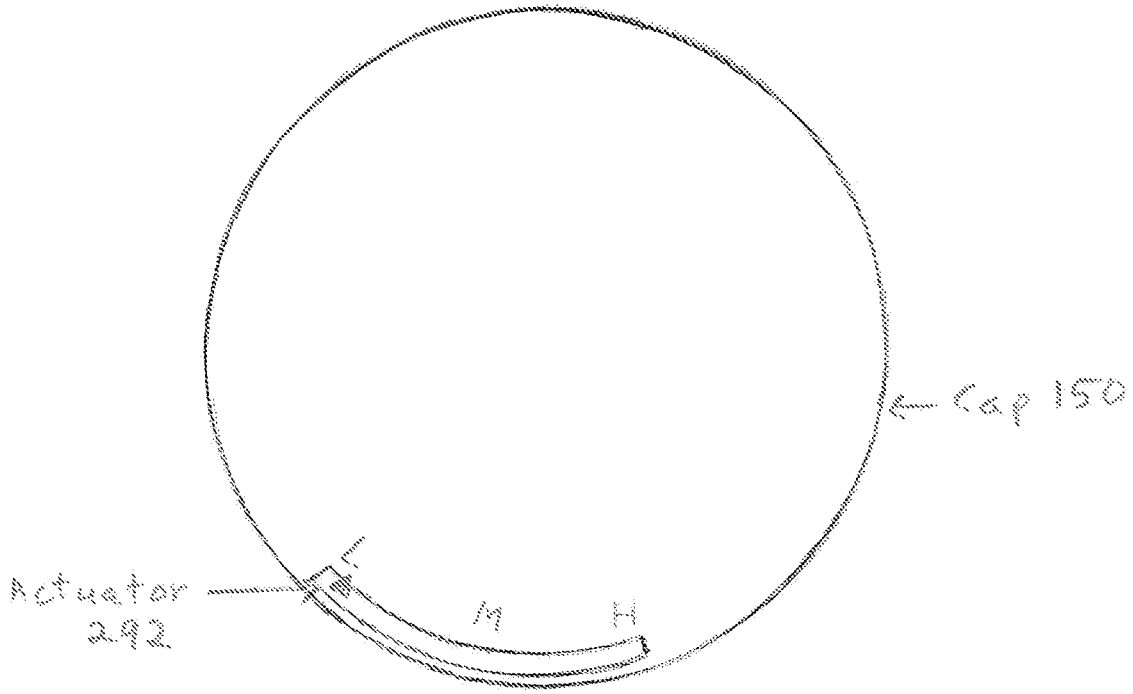
Figure 3a Fluid Flow Reading
293
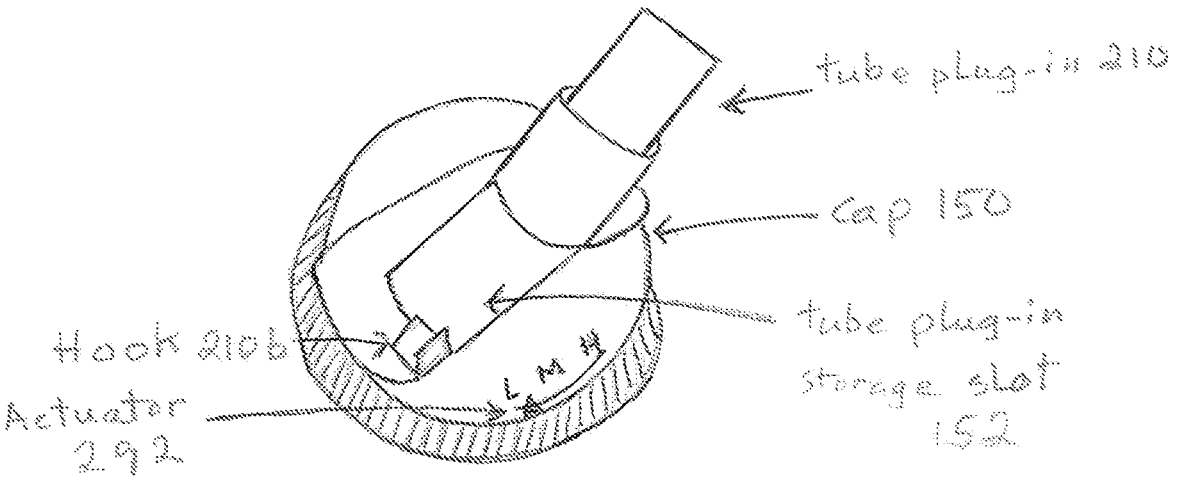
Figure 3b Tube plug-in and
its storage slot

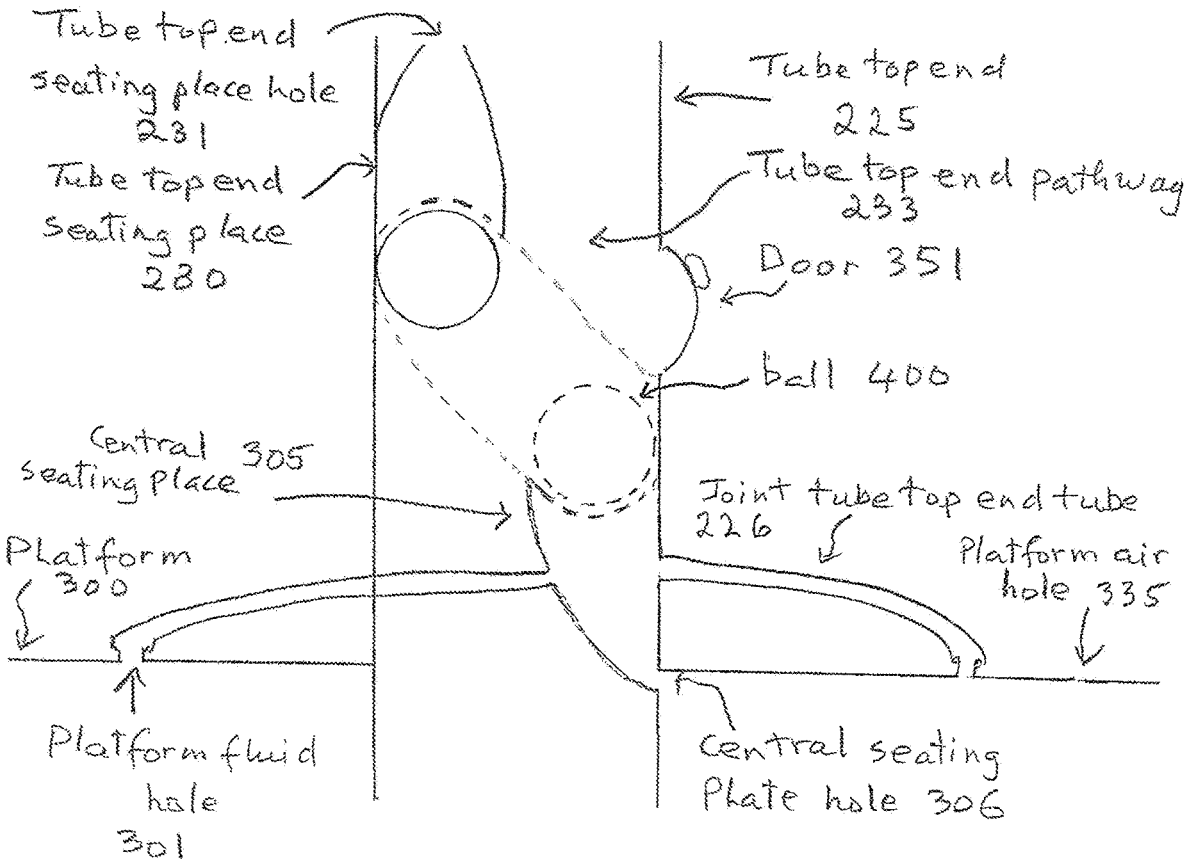
Figure 4. Switching mechanism between lying and sitting positions

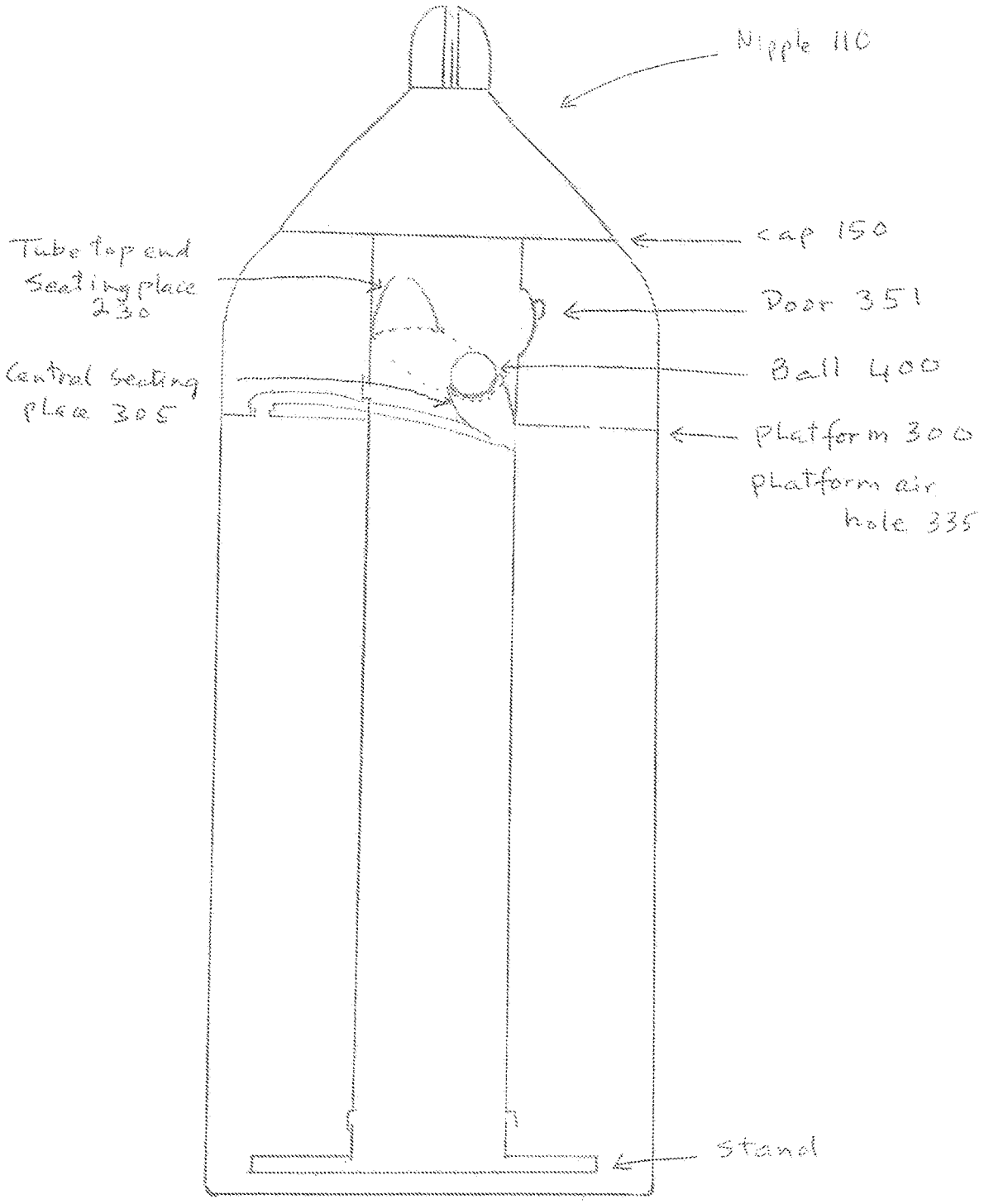
Figure 5 The suitable container

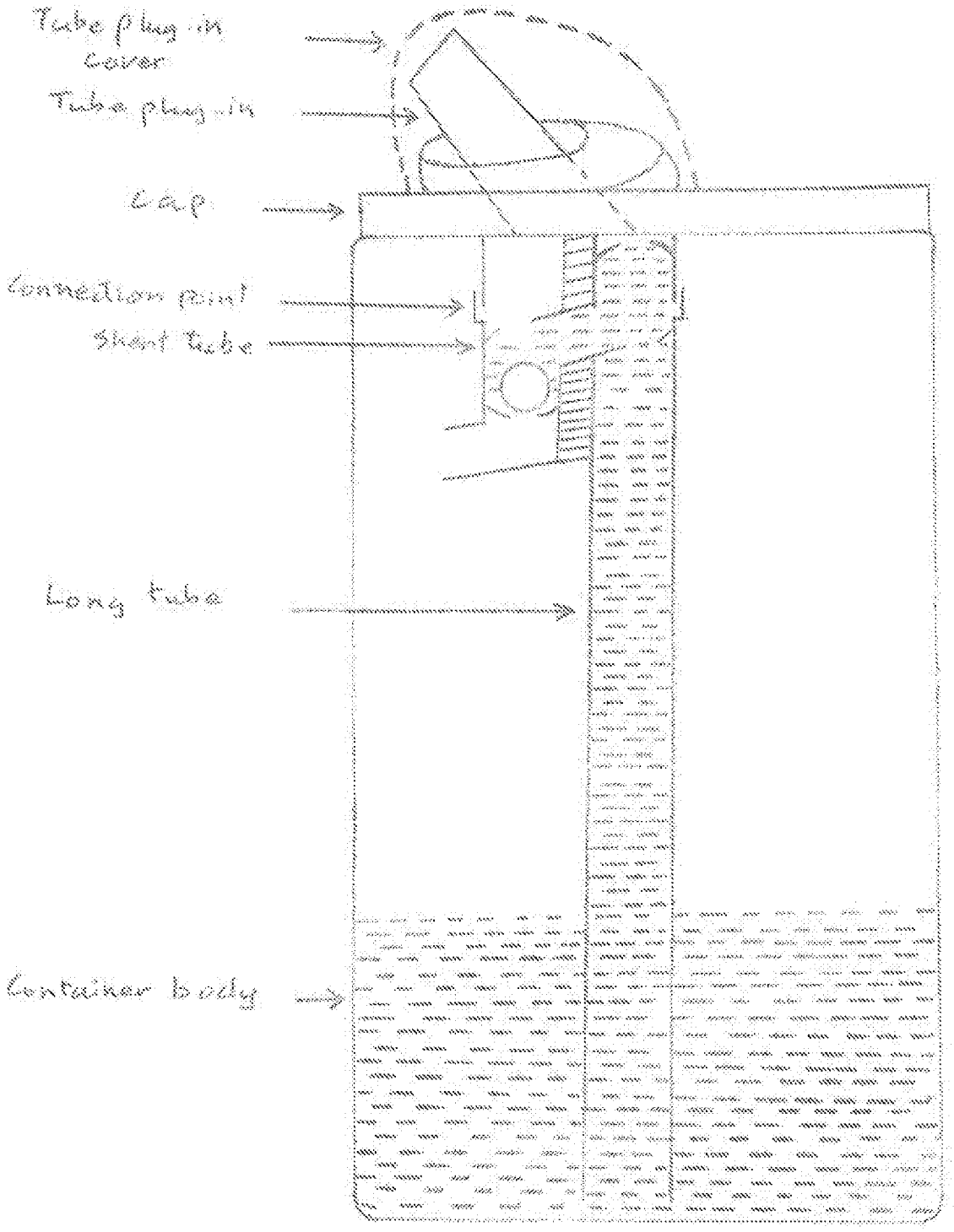
Figure 6 Drinking while sitting

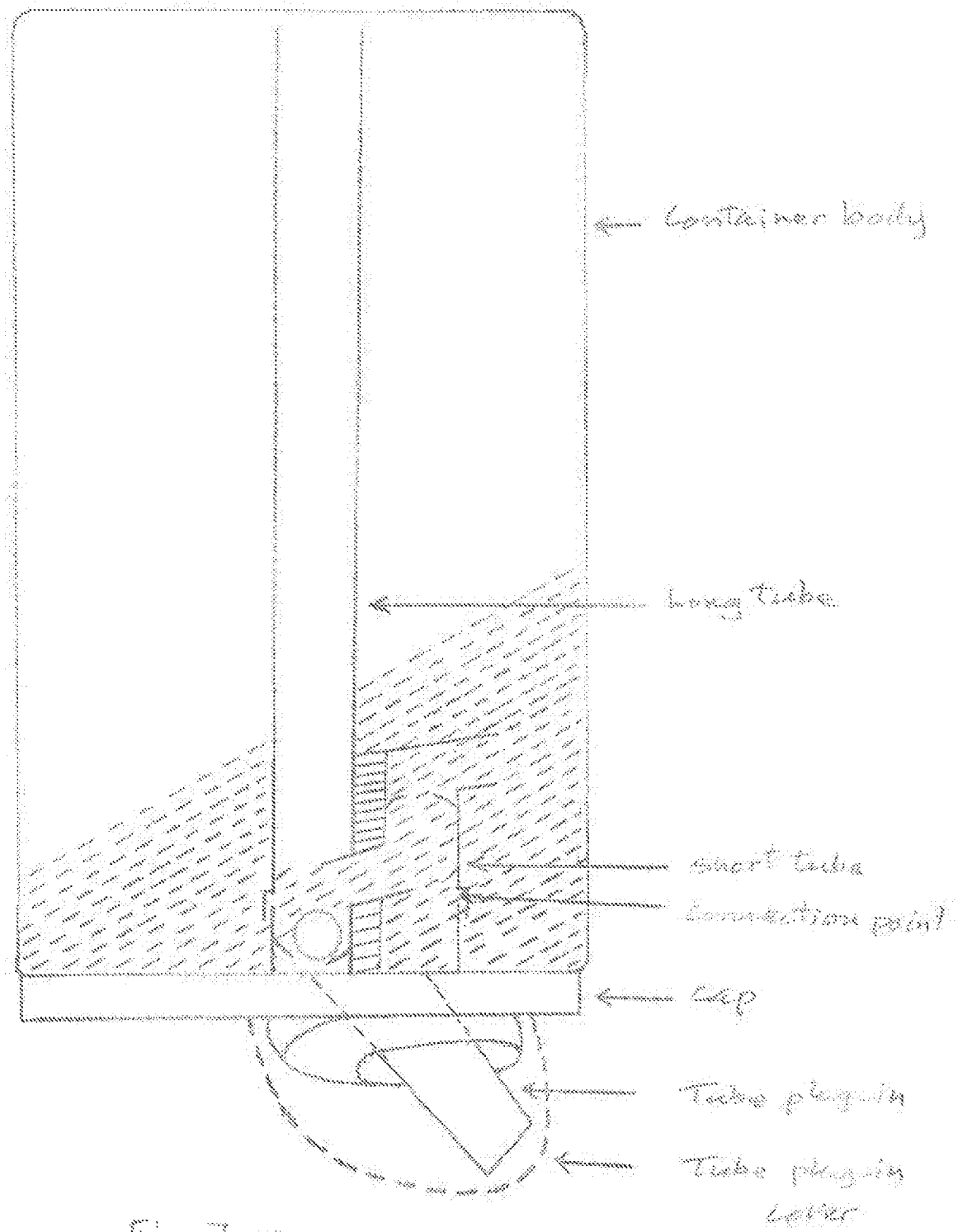
Fig. 7 Drinking while lying

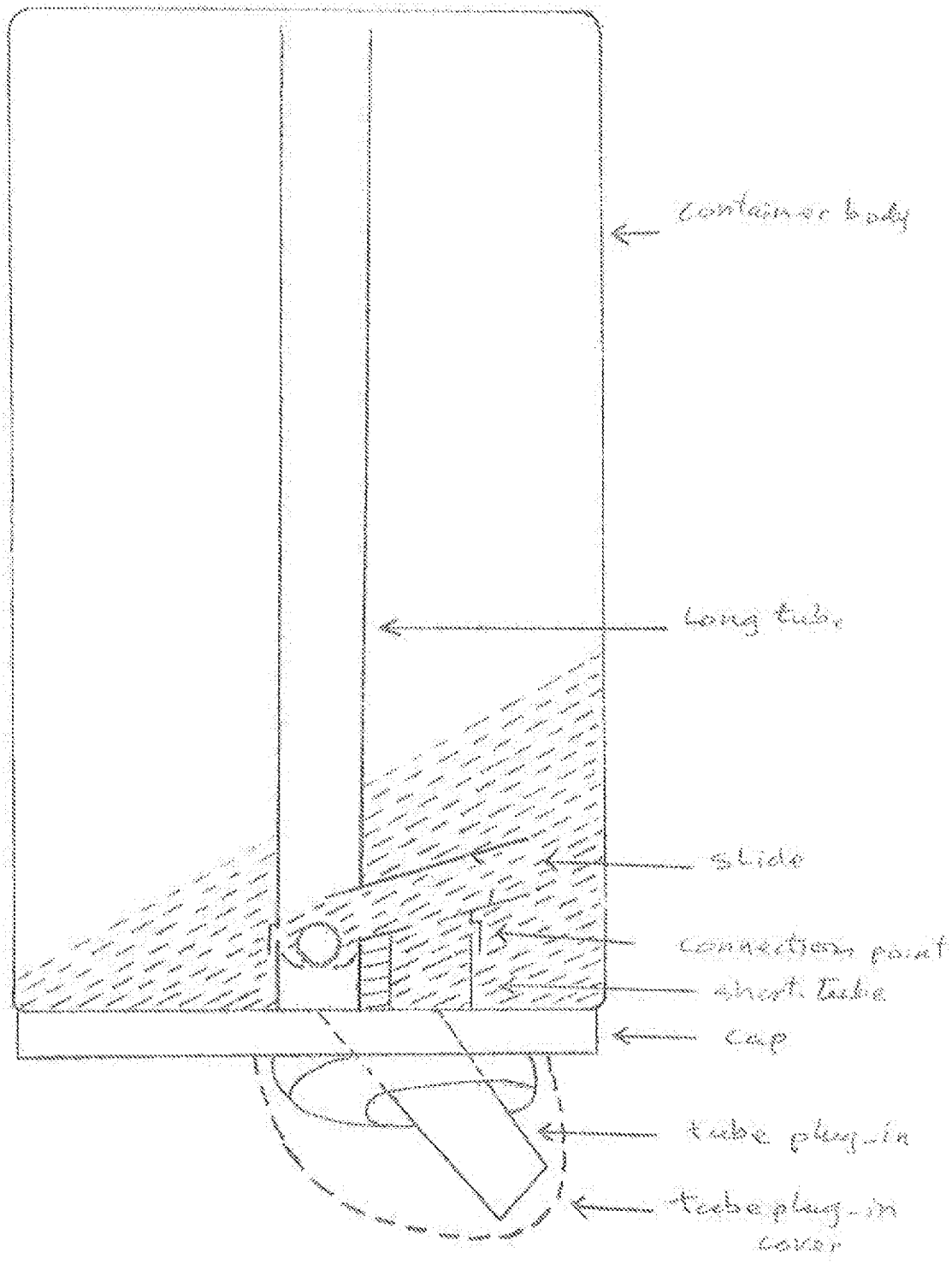
Fig. 8 The slide bottom in place of the short tube bottom at laying position

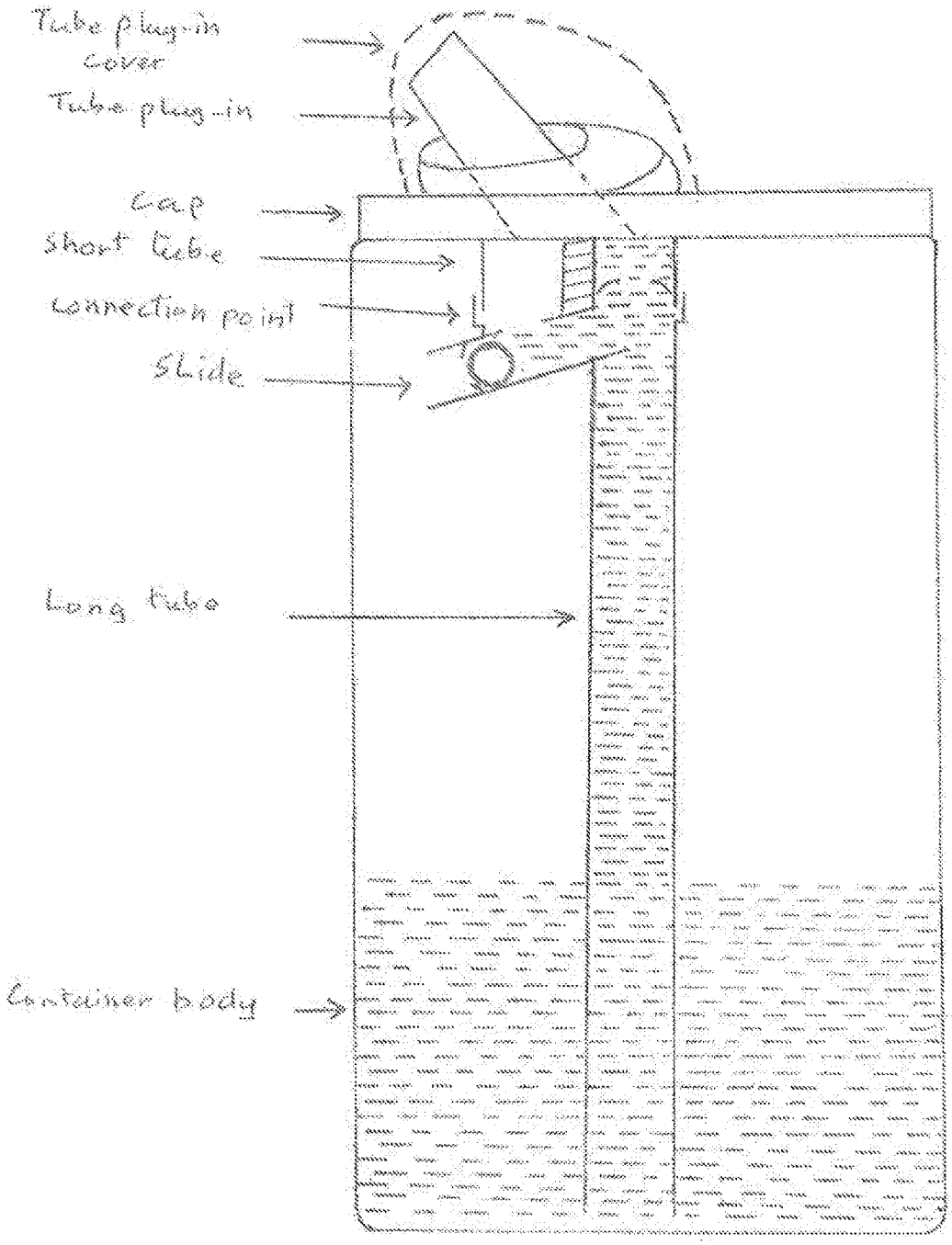
Fig. 9 The slide bottom in place of the short tube bottom at sitting position

SUITABLE CONTAINER FOR CHILDREN AND ADULTS AT LYING AND SITTING POSITIONS

This Non-provisional patent application under the title of "THE SUITABLE CONTAINER FOR CHILDREN AND ADULTS AT LYING AND SITTING POSITIONS" is a continuation-in-part (CIP) to the Non-provisional patent application Ser. No. 16/709,419 filed on Dec. 10, 2019 under the title of "THE LIQUID BOTTLE FOR COMFORTABLE USE AT LYING AND SITTING, STANDING, AND WALKING POSITIONS" and the Provisional Patent Application Ser. No. 62,797,402 filed on Jan. 28, 2019 under the title of "BOTTLE TO DRINK MILK, WATER AND JUICES AT LYING AND STANDING POSITIONS" and the Amendments (specification, claims and drawings) filed on Feb. 6, 2019 to the same Provisional Patent Application Ser. No. 62,797,402 and to the Non-provisional patent application Ser. No. 15/984,435 filed on May 21, 2018 under the title of "The air-free flow-control feeding bottle" and the Provisional Patent Application Ser. No. 62/707,138 filed on Oct. 23, 2017 under the title "Air-free flow-control Feeding Bottle". Finally, this is another amendment to the amendments filed on November 14/Nov. 18, 2020, on Oct. 31, 2020 and on Sep. 15, 2020, of which these amendments including Specifications, Claims and Drawings are in the continuous support of the CIP patent application Ser. No. 16/999,418 filed on Aug. 21, 2020.

This invention tries to solve the problems that a mother having a milk bottle mostly used at a lying position cannot feed her baby inside a baby carrier at an upright position while going on shopping or being busy doing something.

This container also satisfies my desire some 38 years ago when I fed my boy, I noticed that every time he sat and drank milk at lunch or at dinner or juices during the day he had to turn his head all the way to the back holding the bottle upside down to suck in the fluid. The position is quite uncomfortable. There has not been a single container on the market that helps the children drink milk or juices comfortably while at the sitting position and the container can be cleaned with ease.

All the milk bottles currently available on the market are either for use at lying or at sitting, standing and walking positions. They usually require the mother to hold her baby face up and lie horizontally so she can feed her baby. This undoubtedly disrupts what she is doing. With this invention, the mother can feed her baby inside the baby carrier at an upright position and she can continue to do what she is doing and her baby continues drinking milk at its upright position comfortably. In other words, the mother can feed her baby while she/he is lying horizontally or while she/he is sitting, standing, and walking using the same suitable container.

Baby bottles also called as nursing or feeding bottles are primarily used by infants and toddlers. The bottle is provided with a teat/nipple which allows the baby to drink directly from the bottle by sucking on the teat/nipple provided. It is often observed that even after the baby has stopped sucking on the nipple, the fluid present within the bottle continues to flow out; this causes an overflow of the fluid in the baby's mouth, nose and even ears leading to nose/ear infections. This happens because the feeding bottles do not have any kind of flow control mechanism that would prevent the fluid present within the feeding bottles from being dispensed when the baby is not actively sucking from the bottle. Due to this, after feeding the back of the baby needs to be patted so that the air which has been ingested is released by burps. If the ingested air remains in the baby's stomach, it could lead to stomach upset and indigestion.

THE FIGURES

FIG. 1 shows a teat/nipple

FIG. 2 shows a tube plug-in

FIG. 3 shows a flow control mechanism.

FIG. 3*a* shows a fluid flow reading.

FIG. 3*b* shows the tube plug-in and its storage slot.

FIG. 4 shows a switching mechanism for the lying and sitting positions.

FIG. 5 shows a suitable container for children and adults.

FIG. 6 shows a suitable container at the sitting position.

FIG. 7 shows a suitable container at the lying position.

FIG. 8 shows a suitable container at the lying position using the slide bottom.

FIG. 9 shows a suitable container at the sitting position using the slide bottom.

1. THE CONTAINER

The bottle or the liquid bottle or the suitable container 100 holds any safely consumable/drinkable liquid or fluid. The safely drinkable liquid or fluid can be milk, water, tea, coffee, fruit juices, soft drinks, beverages, and the like. The safely consumable/drinkable liquid or fluid is called the fluid here for reason of simplicity, consistency and continuity.

The container 100 can be in any shape and form of different colors. It can hold various ounce capacity volumes. For new-born babies the volume is up to 6 ounces. For 6 to 9 months old children the volume is up to 9 ounces. For over 9 months old children the volume is up to 12 ounces. For children 4 years old and over the volume is over 12 ounces. For adults the volume is over 20 ounces. In other words, the volume can expand appropriately as the age group requires. As a result, a volume marking is required for the container.

The container 100 has an open top 122 and a threaded neck 125 which is engaged with a threaded cap 150, a container body 140 and a container bottom 142. The container bottom 142 can be a removable container bottom 144. The removable container bottom 144, once removed can be used as a cup for soup. The threaded container bottoms top 138 is configured to engage with the threaded container body end. The removable container bottom 144 might be hinged with the container body end 141. However, the container can be a closed bottom.

When the cap 150 as shown in FIG. 5 is screwed to the neck 125 of the container air/fluid tight without any chance for leakage. The cap 150 has a cap hole 153 that goes over the nipple 110 or the tube plug-in 210 or the tube top end opening 215. The cap 150 has a cap cover 155. The cap 150 has a storage space 152 for the nipple 110, the tube plug-in 210 and the tube top end opening 215. The cap hole 153 has space on top for the tube plug-in 210 and the nipple. There is an air hole 154 to prevent the air from mixing the fluid which can cause discomfort to the babies. A plate 162 with a hole that fit the bottoms of the nipple or the tube plug-in is used to twist or snap shut tight the nipple or the tube plug-in to the cap hole 153 of the cap 150.

The cap cover 155 snap-shuts to the cap 150 to cover and keep the nipple 110 or the tube plug-in 210 and the tube top end opening 215 clean. The cap cover 155 can be set up in a way that it is not an obstacle to a child sucking in milk and can be used as a soup cup. The cap cover 155 might have or might not have a storage slot 152 on the container 100. The cap cover 155 can be seated on the cap upper ring 149. The cap cover 155 can be a stand-alone item. The cap cover 155 can be hinged with the cap 150 with a spring 151 positioned on either side of the hinge or on the cap 150 and with another spring 154 holding a latch inside a button release 153 on the cap 150. When the button release is pushed in, the spring 151 will spring off the cap cover 155 instantly from the cap 150. The cap cover 155 can be attached to the cap 150 or the container neck 125.

The cap 150 or the shoulder of the container body can have two slots on both sides for different set of handles 176. Therefore, there are several sets of handles of various shapes and forms that fit the baby design. The handles are in another way for the babies to hold the container.

The Nipple 110 has an opening coupling to the neck of the container body. The nipple 110 (FIG. 1) and the tube plug-in 210 (FIG. 2) has one hole 214 carefully made on top for flow control. The hole sizes depend upon the children ages. For new-born babies the nipple/tube plug-in hole size allows a few drops of milk to drip out immediately when the bottle of milk is turned upside down and then the dripping stops. There is a tube 111 within the nipple 110. This tube 111 has a free or open end on top and a sealed end 114 at bottom. There is a cut 116 at the bottom. The sealed end cut 116 is adapted to allow liquid flow at the open position, wherein the user is using the container and to disallow the liquid flow at the closed position, wherein the user is not using the container.

The tube plug-in 210 is of various shapes and forms. In this embodiment it is round or rectangular with a bigger bottom. There might be a nipple on top of the tube plug-in. There is a collar 161 proximate the bottom fitted around the tube plug-in. There is a tube plug-in storage slot 152 on the cap 150. When the tube plug-in is folded down in its storage slot 152, the tube plug-in bent against the bottom of the collar stopping the fluid flow.

The cover 211 of the tube plug-in 210 or the nipple 110 has a storage space on the cap 150. The storage slot cover 211 is hinged to a backwall of the storage slot 152 for the tube plug-in 210 or the nipple 110. The cover 211 can be open all the way to the back and snap-shut on the cap. When the tube plug-in 210 is bent down under pressure and locked in its storage slot 152, the tube plug-in cover 211 is lifted all the way to the surface of the cap 150 and snap-shut there. The cover 211 can move down and lies on the inside rim of the wall of the storage slot 152 where the cover 211 can snap-shut on the rim. The cover 211 keeps the tube plug-in or the nipple clean. The wall of the storage slot encloses the nipple 110, the tube plug-in 210 or the tube top end opening 215 except an opening for a push 148. The push is used to fold down the nipple 110, the tube plug-in 210 or the tube top end opening 215 against the rod positioned inside the storage slot 152. The push 148 rests upon the outside container or inside its storage slot 141. However, the cover 211 can be a standalone component covering the nipple 110, the tube plug-in 210 or the tube top end opening 215. The cap cover 155 can also be used to cover the nipple 110 or the tube plug-in 210 without the cover 211. However, the cover 211 can have a minor mechanism inside itself in coordination with the rod 149 repositioned inside the storage slot 152 to fold down the nipple 110, the tube plug-in 210 and the tube top end opening 215 to shut off the fluid flow.

The nipple 110 or the tube plug-in 210 can be built or shaped slanting toward the user. If they are standalone parts, they can be surrounded with a drinking base 160 coupling to the cap hole 153.

The container body 140 has a container holder 175. The container holder 175 is placed on the container shoulder 174, or on the cap 150 or on the container body 140 or even over the outer neck ring 147 of the container 100. The container holder 175 should be positioned in a way that is beneficial and unharmful to a child while holding the bottle.

The hand grips 178 can be designed to replace the container holder 175. The hand grips 178 can be done at the middle of the container body. The hand grips can be shown in other ways such as some hand grips with a handle in the form of a rectangle or a half circle or a curve having a hole for easy holding on each side of the container 100. The handgrips 178 can be done in combination with the container holder 175.

On the surface of the outside body of the container come with different images depicting humans, animals, sceneries, or anything that may interest babies and children.

A strainer 185 is fitted on top of the open top of the container neck 125. Mothers use it to squeeze different types of fruit to get the juices for children to drink.

The container 100 has a structure, a device or means to enable a child or an adult to drink milk or water, and the like in a lot more comfortable manner at sitting, standing, and walking positions without her or his head tilting backwards awkwardly. This is in sharp contrast with most milk/water bottles now available on the market!

The exterior wall of the container neck 125 has a space for a container strap 126 for easy carriage. The container 100 has a container case 129. The strap 126 is adjustable for hand holding or for going over the shoulder or the neck. The container strap 126 is made from high density fabric. The strap 126 should be designed and positioned in a way that is beneficial and unharmful to the child while carrying the container case 129.

Depending upon the style, the look and the attractiveness, the container 100, the cap 150, the cap holder 155, the container holder 129, the container strap 126, the container case 129, the nipple 110, the tube plug-in 210, the tube top end opening 215 and other components of the container can be designed appropriately in other ways to meet the safety and demand of the public. In addition, they should be made of the safest and most suitable materials.

The nipple 110, the tube plug-in 210 and the tube top end opening 215 are flexible and made of very highly medically accepted silicone standard. They are soft and easily bendable. Of course, these components are free of BPA (bisphenol A), BPS (bisphenol S), BPF, a compound used in plastic to increase the thickness and durability. All these compounds are harmful.

2. THE FLOW CONTROL MECHANISM

The flow control mechanism 340 comprises two pieces, a first plate 290 comprising a set of holes of increasing perimeters circumferentially placed, and a second plate 291 having a cutout such that when the second piece placed onto the first piece, a selection of holes from the set are exposed, wherein the two pieces are coupled to the first part and the second part, so that to establish the flow of the fluid through the selection of the holes exposed. A flow control reading 293 is embossed in proximity to the actuator to indicate for a particular movement of the actuator 292 from low to medium to high as the fluid is allowed to flow. An actuator 292 and a flow control reading 293 are installed on the top edge of the container cap 150. Both the first and second plates can be installed on the inner sidewall of the container neck 125. There is a short curved gap called Fluid Control Reading curved along a small section of the rim of the cap 150 where the actuator 292 with a nod 292*a* to move from low (L) to medium (M) to high (H) embossed on the curved gap of the cap 150. This is the place where the tube plug-in 210 and the tube top end 225 meet. There is a good cushion 225*a* on the top of the tube top end 225 for a good coupling by the tube plug-in 210.

3. THE DEVICE ASSEMBLY 250

The design of this CIP marks a clear improvement over the set-up and the operation for the container to be used at both the lying and sitting positions. The improvement is obviously seen in the reduction from the use of 4 balls to the at least one and the creation of the device assembly 250.

The device assembly 250 includes the tubes 201, the short tube and the tube 203, the long tube, the ball 400, the slide 308, the combined tube 205 which is sealedly connected to and merged from the tubes 201 and 203. Tubes 201 and 203 are of various forms and shapes. In this embodiment they are round. The combined tube 205 can be the nipple 110, the tube plug-in 210 or the tube top end opening 215. Its size in diameter is roughly half that of tubes 201 or 203 combined. The device assembly 250 is designed with tube 201 and 203 side by side connected by the slide 308. Tubes 201 and 203 have holes through the slide such that the fluid flow will go through the slide 308 at the sealedly connected holes with the tube 201 and 203 from top to bottom of the slide 308 at the cut. The sizes of the tubes 201 and 203, the slide 308 and the ball 400 vary according to the age groups. However, flaps 270 and rings 271 can be installed inside those tubes and the slide to prevent the ball from going off course. However, it is best to position them at the connection point 208 in such a way that they do not interfere with the ball 400 getting into the slide 308 with ease.

In one embodiment, both tube 201 and tube 203 are positioned side by side. At the point where the tube tops 206 and 207 of the tubes 201 and 203 are met in a tube top base 209 before the tubes 201 and 203 are merged into the combined tube 205, only air can go through inside the tube 201 and 203 at the tube top base 209. Tube 201 has a short tube bottom 202. As a result, the tube 201 may be curved toward the inner wall of the container body 140 proximate the cap. Tube 203 has a long tube bottom 204 proximate the bottom of the container. It is noted that under this embodiment, the following parts do not exist as listed below:

a. The tube 200 is eliminated,
b. No tube top end seating place 230 and no central seating place 305,
c. no platform 300 because the platform 300 is merged into the cap 150,
d. no platform fluid holes 301,
e. no joint tube top end tubes 226,
f. no one-legged stand 279, and
g. no door 351.
h. No fluid holes The tubes 203 and 201 have the same purposes as mentioned in previous amendments. Tube 201 is used for the lying position while Tube 203 is for the sitting, standing or walking position. Tube 201 and tube 203 are joined by a slide 308. The slide 308 is of various forms and shapes but in this embodiment it is round and open-ended. It is the ball 400 created for the two-way container, one at the sitting position and the other at the lying position. The slide 308 has two positions, one at the sitting position and the other at the lying position. The ball 400 is always at the opposite side of either the sitting or lying positions. When the user is at the sitting position, the ball is always at the lying position, which is upon the rim 311 of the short tube 201, disallowing fluid flow at the short tube 201 but allowing the fluid flow to pass through the long tube 203. When the user is at the lying position, the ball 400 is always at the rim 236 of the long tube 203, disallowing the fluid flow through the long tube 203, but allowing the fluid flow to pass through the short tube 201. The ball 400 can only travel from tube 201 to tube 203 and vice versa by the slide 308. There is no other route for the ball 400 to travel. The ball 400 always stays inside the slide 308.

The cap hole 153 has a fitting position on top of the cap 150, the top cap hole 143 for the drinking base 160 and the bottom cap hole 144 for the tube top base 209. In other words, the cap hole 153 accommodates for both the drinking base 160 and the tube top base 209. The tube plug-in 210 can be like a nipple with a carefully made hole for the user to suck in the fluid. As mentioned above, tubes 201 and 203 can be merged into one combined tube 205 which can be turned into (1) a nipple 110, (2) a tube plug-in 210 and (3) a tube top end opening 215. A seal 154 positioned at the cap hole 153 to secure and hold either the combined tube 205 or the tube top base 209 in place air/fluid tight.

The tube plug-in 210 may have a nipple on top with a carefully made hole for fluid control purposes and like a nipple it is used for new-born babies up to 12 months old. The tube top end opening 215 is open top of various sizes, shapes and forms. Normally it is round and equal to ½ the size in diameter of tubes 201 and 203 combined. It is used for children of over 12 months old. It is absolutely used for adults.

Tubes 201 and 203 with their bottoms 202 and 204 are built slanting toward the user. In this way tube bottoms 202 and 204 can catch most of the fluid on the side of the container toward the user. Tube bottom 202 of the short tube 201, a portion of the short tube past the slide at the bottom of the slide 308 is tilted toward the user and proximate the cap 150. It is noted that the nipple 110, the tube plug-in 210 or the tube top end opening 215 and the bottoms of tubes 201 and 203 are built tilting the side of the container body toward the user. However, the tube 204 can also be straight down proximate the bottom of the container body.

Another way to achieve the set-up just mentioned above is that the slide 308 is extended further with its bottom 317, a portion of the slide 308 past the short tube 201, a little bit curved upward proximate the cap 150 replacing the short tube bottom 202 of the short tube 201. The connection between the short tube 201 and the slide 308 remains the same as before but without the short tube bottom 202. This set-up has the new rim 310 of the slide 308 just past the short tube 201. The ball 400 now travels back and forth from the rim 236 of the long tube 203 to the rim 310 of the slide 308. It is here noted that when the short tube 201 connected with the slide 308 and the slide bottom 317 is used to draw in the fluid proximate the cap, the short tube 201 is used without its bottom 202. At the lying position the ball 400 parks at the rim 236 of the long tube 203 disallowing the fluid flow to pass through the long tube 203. The slide bottom 317 is open allowing the fluid flow to go through the slide bottom 317 to the short tube 201 into the nipple 110 or the tube plug-in 210 or the tube top end opening 215. At the sitting position the ball 400 is at the rim 310 of the slide 308 disallowing the fluid flow through the slide bottom 317 and the short tube 201 allowing the fluid flow to pass through the long tube bottom 204 into the nipple 110 or the tube plug-in 210 or the tube top end opening 215. In other words, the slide bottom 317 is treated exactly like the short tube bottom 202. Please, review the new FIGS. 8 and 9. The slide extension as mentioned above which is actually the slide bottom 317 has the duty exactly like the short tube bottom 202. Therefore, the slide bottom 317 and the short tube bottom 202 are interchangeable. The ball 400 cannot travel through the slide bottom 317. The ball 400 is stopped at the rim 310 of the slide 308.

Taking either the lying position or the sitting position as a reference point, it is noted that at the lying position as a reference point the ball 400 is at the rim 236 of the long tube 203 which is adapted to be at a lower position than at the rim 311 of the short tube 201. In the same token, if the sitting position is the reference point the ball 400 is at a lower position at the rim 311 of the short tube 201 than at the rim 236 of the long tube 203.

In another embodiment, tube 201 with its short tube top 206 and its short tube bottom 202 and its rim 311 and tube 203 with its long tube top 207 and its long tube bottom 204 and its rim 236 can achieve the purposes of "the comfortable container for children and adults at the lying and sitting positions" without the tube 200. The tube 200 is eliminated. Tubes 201 and 203 including the combined tube 205, the ball 400 and the slide 308 with the switching mechanism are of one system called the device assembly 250. For the ball 400 to get inside the tubes 201 and 203, it can be pushed through the bottom 202 through the rim 311 or through the connection point 208. The connection point 208 breaks apart tubes 201 and 203 near the slide 208 into upper parts proximate the cap 150 and the lower parts which are reassembled into tubes 201 and 203. The connection point 208 achieves (1) dropping the ball 400 inside a very small portion of the tubes 201 and 203 and the slide 308 and (2) cleaning tubes 201 and 203 and the tube plug-in 210 or the nipple 110 or the combined tube 205 with a brush. The door 351 is eliminated due to the safety of children.

The ball 400 can go through the slide 308 from tube 201 to tube 203 and vice versa and no other route. Once the ball 400 is inside the slide 308, it cannot get loose and be out, which is very safe for children.

The cap hole 153 has a seal 154 used to seal air/fluid tight the tube top base 209 which prevent the fluid from leaking through the tube tops 206 and 207 in case there is a drinking base. The tube tops 206 and 207 are enclosed air/fluid tight in a tube top base 209. The tube top base 209 is used either with the combined tube 205 or the drinking base 160. Both the tube top base 209 and the drinking base 160 are aligned smoothly for easy fluid flow.

The cap hole on top of the cap 150 called the top cap hole 158 is for the nipple 110 or the tube plug-in to be positioned in. A plate 162 is used to secure them inside the top cap hole 158. There is a rod 149 inside the storage slot 152 sealedly connected to the surface of the cap 150 and is created for the purpose of stopping the fluid flow whenever the nipple 110 or the tube plug-in 210 or the tube top end opening 215 is folded down in its storge slot 152. This set-up eliminates the use of the collar 161. To get the nipple 110, the tube plug-in 210 or the tube top end opening 215 folded into their storage slot, there is a push 148 positioned outside the storage slot 152. The push 148 cannot interfere with the sucking in the fluid by the babies.

As mentioned above tube 201 is used while at the lying position. Its bottom 202 is tilted close to the side of the container body 140 in the same direction of the nipple 110 or the tube plug-in 210 or the tube top end opening 215, that means toward the user. At the lying position, the user draws in the fluid from the side of the container body 140 proximate the cap 150 not from the bottom of the container body. Tube 201 is much shorter than tube 203, hence the short tube.

Tube 203 is long and is used for the sitting position. Its bottom 204 reaches almost to the bottom of the container body 140. Tube bottom 204, positioned close to the side of the body toward the user, draws up the fluid at the bottom of the container body 140. Hence Tube 203 is the long tube. However, tube 203 is slanting toward to the side of the container to catch all the fluid in the container toward the user. This set-up eliminates the use of the at least one-legged stand 279.

It is worth mentioning that both the short tube bottom 202 and the slide bottom 217 are interchangeable.

The container 100 has the device assembly 250 including the combined tube 205, the short tube 201, the long tube 203, the ball 400 and the slide 308 offering a user an opportunity to use the same container for the lying and sitting positions and sucking in the fluid comfortably at both positions. The container 100 is, indeed a two-way container 100.

In case no ball is used. But there is a need for the lying and sitting positions. The tubes 201 and 203 without a slide are cut off at the junction with the cap 150. The Container section, the drinking base 160 with the plate 162 and the tube top base 209 are used for this purpose. The plate 162 is used to secure the drinking base 160 to the top cap hold. Another plate 161 is positioned between the drinking base 160 and the tube top base 209 on the top surface of the cap 150. When the lying position is required, the plate 161 is moved to shut off tube 203 and the sitting position. When the sitting position is required the plate 161 is moved to seal off the tube 201 and the lying position.

When the ball 400 is seated upon the rim 236 of tube 203, it signals that the user is at the lying position and tube 201 is open for the fluid flow. The fluid cannot pass through tube 203. Please, review FIG. 7. At the lying position, the user holds the container upside down and sucks down the fluid comfortably through the short tube 201.

When the ball 400 is seated upon the rim 311 of tube 201, it signals that the user is at the sitting position and tube 203 is open for the fluid flow. The fluid cannot get through tube 201. Please, review FIG. 6. At the sitting position, the user holds the container upright and sucks in the fluid comfortably. The user never holds the container upside down and tilts her/his head all the way backward to suck down the fluid as seen with the milk bottle mostly used nowadays. This is one of the big differences between this container 100 and most other milk bottles.

All the rims 311 and 236 and 310 have good surfaces for contact such that when the ball 400 is seated upon the rim, the ball seals off air/fluid tight over the rim.

The ball 400 corresponds accordingly and promptly to whatever position the user is taking.

As said above the formation of the device assembly 250 and its operations in coordination with the ball 400 and the slide 308 clearly demonstrates the fact that the device assembly 250 is a means for a user to drink the fluid comfortably at the sitting position as well as at the lying position.

The tubes 201 and 203 including the nipple 110 and the tube plug-in 210 are made of highly and medically accepted plastics or silicone standard. All the components just mentioned above can be designed and made in other suitable ways that meet the highest medical standards and at the same time deliver comfort and usefulness to the user.

4. THE BALL 400

There is at least one ball 400 used in this container 100. The ball 400 can only travel from tube 201 to tube 203 and vice versa via the slide 308. The ball 400 cannot travel in any other way. The ball 400 cannot travel inside and throughout the tubes 201 and 203 including their tube bottoms 202 and 204. If the slide bottom 317 is used instead of the short tube bottom 202, the ball moves from the rim 310 of the slide 308 to the rim 236 of the long tube 203.

The ball 400 is unique in the sense that it is used (a) to seal air/fluid tight on the rims 311 and 236 of tube 201 and tube 203 and (b) as a switch between the lying position and the sitting, standing and walking positions.

a When the ball 400 is at the rim 311 of tube 201 or the rim 310 of the slide 308, the user is at the sitting, standing and walking position and she/he is drinking up the fluid from the bottom of the container 100 into the tube plug-in 210 or the nipple 110 or the tube top end opening 215. The pathway for the fluid flow through the tube bottom 202 or the slide bottom 317 is blocked. The user is holding the container 100 upright and drinking the fluid comfortably without tilting her/his head backward awkwardly and not holding the container 100 upside down as seen in most milk and water bottles.

b When the ball 400 is at the rim 236 of tube 203, the user is at the lying position and she/he is sucking in the fluid through the tube bottom 202 of tube 201 or the slide bottom 317 of the slide 308 into the tube plug-in 210 or the nipple 110 or the tube top end opening 215. The pathway through the tube 203 is blocked. The user is holding the container 100 upside down and drinking the fluid comfortably.

The ball 400 provides an automatic way to drink the safely drinkable fluids at the lying or sitting positions. In whatever position the user is taking the ball 400 corresponds accordingly nicely.

There is another way to achieve the drinking at the lying and at the sitting positions. This way requires no ball but a little effort of labor. A small plate 161 is positioned between the bases 160 and 209. The plate 161 is moved to seal air/fluidtight either tube 203 for drinking at the lying position, or to seal air/fluidtight tube 201 for drinking at the sitting position.

The ball 400 is made of medically accepted high quality stainless-steel, aluminum, silicone and plastics.

All the components of the container 100 can be designed and constructed in any suitable shape, suitable form, suitable volume, suitable materials and suitable structures as professionally recommended and as highly demanded that should meet the highest medical standards and should be most beneficial and absolutely unharmful to children or anyone using it. These components are free of BPA (bisphenol A), BPS (bisphenol S), BPF, a compound used in plastic to increase the thickness and durability. All these compounds are harmful. In addition, it is easy to clean, hold, carry and store.

5. OPERATION OF THE CONTAINER 100

First disassemble the tubes 201 and 203 at its connection points 208 to dop in the ball 400 into the tubes 201 and 203 and the slide 308. Then reassemble the tubes 201 and 203. Secure the nipple 110 or the tube plug-in 210 and the tube top end opening 215 through the cap hole 153 and the cap 150 to the neck 125 of the container body 140. The container 100 offers two positions to drink comfortably:

a. FOR THE LYING POSITION, when the ball 400 is on the rim 236 of the tube 203, it allows the fluid flow near the cap 150 to get through the tube bottom 202 of the short tube 201 or the slide bottom 317 of the slide 308 into the short tube (the upper portion) into the nipple 110 or the tube plug-in 210 or the tube top end opening 215. It disallows the fluid flow pathway from the long tube bottom proximate the bottom of and the side of the container body 140 to pass through tube 203. At the lying position, a user holds a container of fluids upside down and sucks in the fluid comfortably.

b. FOR THE SITTING, STANDING, AND WALKING POSITION, when the ball 400 is on the rim 311 of the tube 201 or the slide rim 310 of the slide 308, it blocks the fluid flow near the cap 150 to pass through the tube bottom 202 or the slide bottom 317 and allows the pathway of the fluid flow from the bottom of the container 100 to pass through the long tube bottom 204 into the long tube (the upper portion) into the tube plug-in 210 or the nipple 110 or the tube top end opening 215. At the sitting, standing, and walking position a user holds a container upright and sucks up the fluid comfortably without tilting her/his head all the way to the back awkwardly and holding the container upside down.

c. This is the only container which offers the user to draw in the fluid at both the lying and sitting positions comfortably not holding the container upside down as seen with most containers currently available on the market having to tilt her/his head all the way backward awkwardly to suck in the liquid very uncomfortably at the sitting position. THIS IS A TWO-WAY DRINK CONTAINER.

6. DEVICE ASSEMBLY APPLICATIONS

The container 100 is a useful tool for babies as well as adults to be used at lying and sitting positions. A typical example is that women don't have to stop what they're doing and can feed their babies probably of at least 9 months old in a baby carrier at the upright position using this container 100.

The fully assembled container 100 is also useful for patients in hospitals and nursing homes or even for people at home who cannot get up to have their meals. If the foods are in the form of fluid, the patients can lie down or sit up to suck in the foods using the container 100.

The device assembly 250 can be used alone without the container 100. The device assembly 250 can be used in fruit juice boxes and cans of vegetables and pops.

The device assembly 250 can also be used as a 2-way valve in many industrial applications.

7. THE CLEANING OF THE TUBE AND THE CONTAINER

There is a cleaning mechanism 475 to clean the device assembly 250. The tube section 163 is composed of the lower parts of the tubes 201 and 203 at the connection point 208. This cleaning mechanism 475 includes a fitting with two ends, one end having threads that engage with the threads of an in-house water faucet like the one in the kitchen and the other end attachable to the tube section 163. The tube section 163 is a device securely hooked to the short tube 201 and the long tube 203 at the connection point down. First drop some soft soap inside the lower parts of the tubes 201 and 203. Connect one end of the cleaning mechanism 475 to the tube section 163 and the other end to a kitchen faucet. Then turn on the faucet and let water go through to clean both the lower tubes 201 and 203 and the container 100 thoroughly particularly the slide 308. The other components such as the upper tubes 201 and 203 sealedly connected to the nipple 110 or the tube plug-in 210 or the tube top end opening 215 are cleaned with soap by hand using brushes.

Another way is all the components can all be cleaned by hand with soap using brushes. Then cleaning them again in a dish washer or dipping them in a pan with boiling water. Once the cleaning is done, the components are left to dry in an hour and are ready for use again.

I claim:

1. A container, comprising:

a. a body, b. a combined tube, a nipple or a tube plug-in or a tube top end opening, c. a cap, d. a device assembly including a ball travelling inside a slide connecting between a short tube and a long tube, wherein either the short tube or the long tube is open for a fluid to flow into either the combined tube or the nipple or the tube plug-in or the tube top end opening at a lying position and at a sitting position, wherein:

(1) when the ball is seated upon a rim of the short tube or the rim of the slide, the short tube or the slide is closed blocking a fluid flow through a short tube bottom or a slide bottom, opening the long tube and allowing the fluid flow through a long tube bottom into the long tube into either the combined tube or the nipple or the tube plug-in or the tube top end opening at the sitting position, (2) when the ball is seated upon a rim of the long tube, the long tube is closed disallowing the fluid flow through the long tube bottom, opening the short tube or the slide and allowing the fluid flow through the short tube bottom or the slide bottom into the short tube into either the combined tube or the nipple or the tube plug-in or the tube top end opening at the lying position, and (3) the ball responds promptly according to the lying position or the sitting position the user is taking.

2. The container according to claim 1, is enhanced by materials used to make components of the container either stainless steel or free of harmful chemicals.

3. The container; according to claim 2, is a milk and water bottle for Children.

4. The container; according to claim 2, is a water bottle for adults.

5. The container, according to claim 1, wherein the device assembly further comprising:

a. the short tube and the long tube, whereby the short tube and the long tube make hole cuts through the slide from a top to a bottom of the slide, whereby edges of a bottom end of the short tube and of the top of the slide at the hole cut, and the edges of the bottom end of the long tube and of the top of the slide at another hole cut are sealedly connected, wherein a lower portion of the short tube and of the long tube past said two hole cuts at the bottom of the slide are the short tube bottom and the long tube bottom, whereby said two hole cuts at the bottom of the slide are open for the fluid flow inside the short tube and the long tube, or whereby the edges of the hole cuts are properly fitted in other ways requiring no additional sealed connections along the hole cuts, b. the slide being an open-ended tube in a slanting position with one end inside the short tube and the other end inside the long tube, wherein one end of the slide inside the long tube is above another end of the slide inside the short tube at the sitting position, and wherein one end of the slide inside the short tube is above another end of the slide inside the long tube at the lying position, and c. the ball travelling back and forth between the short tube and the long tube inside the slide to perform a switching mechanism between the lying position and the sitting position.

6. The container according to claim 5, wherein the device assembly further comprising:

a. the short tube bottom positioned proximate the cap and a side of a container body toward the user, while the long tube bottom positioned proximate a bottom of and the side of the container body toward the user, wherein the long tube bottom is in a slanting position proximate the bottom of and the side of the container body toward the user, b. the ball moving inside the slide and within a boundary defined by the rims positioned on an interior surface of the short tube, the long tube and the slide, c. a seal positioned at a cap hole configured to secure either the combined tube or a tube top base and to hold either one at their position air/fluid tight at the cap hole, and d. the short tube being used as a pathway for the fluid flow at the lying position while the long tube is used as the pathway for the fluid flow at the sitting position.

7. The container; according to claim 1, further comprising:

a. a storage slot on the cap for either the combined tube or the tube plug-in or the nipple or the tube top end opening, b. the cap having at least one hole for air preventing the air from mixing with the fluid causing discomfort to a user and another hole configured to go over and to hold down either the combined tube or the nipple or the tube plug-in or the tube top end opening securely in place, wherein the cap has internal threads to engage with external threads of a neck of the container in a water-tight sealed manner, and wherein the cap has a cap cover as a standalone alternative for a storage slot cover configured to keep either the combined tube or the nipple or the tube plug-in or the tube top end opening clean, c. a volume marker configured to indicate various volume holdings of the container, d. a container holder configured to make it easy for the user to hold the container, and e. the combined tube born out of the short tube and the long tube and turned into either the nipple or the tube plug-in or the tube top end opening.

8. The container according to claim 7, wherein the combined tube comprising:

a. the combined tube being turned into either the nipple or the tube plug-in or the tube top end opening, wherein the nipple or the tube plug-in has a carefully made hole for the fluid flow into the user's mouth, and wherein the tube top end opening has an open top for easy fluid flow, b. the combined tube either at an upright position or at a slanting position pointing toward the user, c. the combined tube folded down by an inside plate of the storage slot cover against a rod inside the storage slot to shut off the fluid flow, and d. the combined tube cleaned with soft soap by a brush at a connection point.

9. The container according to claim 7, wherein the cap further comprising:

a. two slots on both sides of the cap or of a shoulder of a container body to be fitted with different sets of handles, wherein the two slots have a right-side slot and a left-side slot and a set of handles has a right handle and a left handle, and wherein the right handle is fitted in the right-side slot and the left handle is fitted in the left-side slot, and wherein if a right handle is broken, only the right handle is ordered, b. the handles having designs of different objects interesting the user, and c. the handles making it easy for babies to hold and to play with them like toys.

10. The container according to claim 1, wherein the device assembly further comprising:

a. a connection point being created at the short tube and or the long tube and/or the slide for cleaning and for dropping the ball inside the slide, b. for a good operation the rims being created inside the slide, the short tube and the long tube to stop the ball from moving off course, wherein the rims are positioned in such a way that they do not interfere with the ball getting inside the slide, c. taking the lying position as a reference point at which position the user is lying and drinking the fluid, the ball seated upon the rim of the long tube is below the rim of the short tube, and d. taking the sitting position as a reference point at which position the user is sitting and drinking the fluid, the ball seated upon the rim of the short tube is below the rim of the long tube.

11. The container according to claim 1, wherein the device assembly further comprising:

a. a tube top base holding tube tops of the short tube and the long tube, b. the rim of the short tube and the rim of the long tube having a good surface for contact such that when the ball is seated upon the rim, the ball covers the rim air/fluid tight, and c. a cleaning mechanism.

12. The container according to claim 11, wherein the cleaning mechanism has an end attachable to an inhouse water faucet and another end connecting to a tube section, wherein when the in-house faucet is turned on, the tubes, the ball, and the slide are thoroughly cleaned with soft soap.

13. The container according to claim 1, wherein the ball further comprising:

a. when the ball is at the rim of the short tube or at the rim of the slide and seals off air/fluid tight the short tube bottom or the slide bottom, a user is at the sitting position, wherein the fluid is drawn from the long tube bottom proximate a bottom of and a side of a container body toward the user into the long tube into either the combined tube or the nipple or the tube plug-in or the tube top end opening, wherein the user is holding the container upright, not upside down and not tilting her/his head backward awkwardly and the user drinks the fluid comfortably, b. when the ball is at the rim of the long tube and seals off the rim of the long tube air/fluid tight, the user is at the lying position, wherein the fluid is drawn from the short tube bottom or the slide bottom proximate the cap and the side of the container body toward the user into the short tube into either the combined tube or the nipple or the tube plug-in or the tube top end opening, and wherein the user is holding the container upside down drinking the fluid comfortably, and c. when the user lies down, the ball switches its position accordingly by moving to be seated upon the rim of the long tube and when the user sits up, the ball switches its position accordingly by moving to be seated upon the rim of the short tube or the rim of the slide.

14. The container; according to claim 13, further comprising:

a. a drinking base including the nipple or the tube plug-in as a standalone component, b. a plate to secure the nipple or the tube plug-in to a top cap hole, c. alignment of the drinking base and a tube top base for the easy fluid flow at both the lying position and the sitting position, and d. the short tube bottom or the slide bottom and the long tube bottom turning in a same direction toward the side of the container body toward the user, wherein the short tube bottom or the slide bottom being proximate the cap and the long tube bottom being proximate the bottom of the container body.

15. The container according to claim 13, wherein the slide comprising:

a. the slide being further extended past the short tube with one end past the short tube being the slide bottom proximate the cap and tilting to the side of the container body toward the user and another end inside the long tube, b. the slide bottom replacing the short tube bottom resulting in a hole cut on a top of the slide, whereby edges of a bottom end of the short tube and of the hole cut on the top of the slide are sealedly connected along the hole cut, or whereby the edges of the bottom end of the short tube and of the hole cut on the top of the slide are properly fitted in other ways requiring no additional sealed connections along the hole cut, and c. the rim being created past the hole cut for the ball to be seated upon inside the slide.

16. The container according to claim 15, wherein the slide further comprising:

a. when the user lies down, the ball switches its position accordingly by moving to be seated upon the rim of the long tube to block the fluid flow throughout the long tube, opening a pathway for the fluid flow from the slide bottom through the short tube into the combined tube or the nipple or the tube plug-in or the tube top end opening, wherein the user holds the container upside down and drinks the fluid comfortably at the lying position, b. when the user sits up, the ball switches its position accordingly by moving to be seated upon the rim of the slide disallowing the fluid flow through the slide bottom into the short tube, allowing the fluid flow throughout the long tube into the combined tube or the nipple or the tube plug-in or the tube top end opening, wherein the user holds the container upright, not upside down and not tilting her/his head backward awkwardly and drinks the fluid comfortably at the sitting position, c. the slide bottom and the short tube bottom are interchangeable, and d. the ball enabled in determining the pathway for the fluid flow through either the short tube or the long tube one at a time between the lying position and the sitting position.

17. The container according to claim 1, wherein the cap comprising:

a. a storage slot with a wall, whereby the wall covers a front and both sides of either the combined tube or the nipple, or the tube plug-in, or the tube top end opening, b. a storage slot cover at a backwall of the storage slot, and snap-shut on an inside rim of the wall of the storage slot to keep either the combined tube or the nipple or the tube plug-in or the tube top end opening clean, and c. a rod sealedly connected inside the storage slot opposite an inside plate of the storage slot cover, wherein either the combined tube or the nipple or the tube plug-in or the tube top end opening is positioned between the rod and the inside plate of the storage slot cover, and wherein the inside plate of the storage slot cover folds down either the combined tube or the nipple or the tube plug-in or the tube top end opening against the rod to stop the fluid flow when the storage slot cover is closed.

18. A method of using a container comprising:

a. Filling up the container with a safely consumable fluid or a fluid, b. Dropping a ball through a connection point inside a slide, c. Positioning a nipple or a tube plug-in or a tube top end opening inside a cap hole, tightening a cap to a neck of the container and the connection point in a watertight sealed manner, d. When the ball is at a rim of a short tube or at the rim of a slide, the fluid from a bottom of and a side of a container body toward a user is drawn into a long tube bottom and passes through a long tube into either a combined tube or a nipple or a tube plug-in, or a tube top end opening, wherein the user is sitting and holding the container upright, not upside down and not tilting her/his head backward awkwardly and the user drinks the fluid comfortably at a sitting position, e. When the ball is at the rim of the long tube, the fluid proximate the cap and the side of the container body toward the user is drawn through a short tube bottom or a slide bottom and passes through the short tube into either the combined tube or the nipple or the tube plug-in, or the tube top end opening, wherein the user is lying and holding the container upside down and drinking the fluid comfortably at a lying position, f. When the fluid runs out, g. Untightening the cap from the neck of the container and removing the cap, h. Dropping some soft soap inside a tube section and connecting one end of a cleaning mechanism to an in-house water faucet and the other end to the tube section, and turning on the in-house water faucet, water cleaning the tubes, the ball and the slide thoroughly, i. Placing either the combined tube or the nipple; or the tube plug-in; or the tube top end opening, and the cap or even the container in a dishwasher for cleaning, j. Letting all components of the container dry for an hour then reassembling them for use again.

19. A container comprising:

a. a body, b. a combined tube or a nipple or a tube plug-in or a tube top end opening, c. a cap, d. a device assembly comprising a ball travelling inside a slide connecting between a short tube and a long tube, wherein either the short tube or the long tube is open for a fluid to flow into either the combined tube or the nipple or the tube plug-in or the tube top end opening at a lying position and at a sitting position, wherein:

(1) when the ball is seated upon the short tube or the slide, the short tube or the slide is closed blocking a fluid flow through a short tube bottom or a slide bottom, opening the long tube and allowing the fluid flow through a long tube bottom into the long tube into either the combined tube or the nipple or the tube plug-in or the tube top end opening at the sitting position, (2) when the ball is seated upon the long tube, the long tube is closed disallowing the fluid flow through the long tube bottom, opening the short tube or the slide and allowing the fluid flow through the short tube bottom or the slide bottom into the short tube into either the combined tube or the nipple or the tube plug-in or the tube top end opening at the lying position, and (3) the ball responds promptly according to the lying position or the sitting position the user is taking.

* * * * *